United States Patent [19]

Kicherer et al.

[11] Patent Number: 4,713,527

[45] Date of Patent: Dec. 15, 1987

[54] RADIANT HEATING UNIT

[75] Inventors: Robert Kicherer; Felix Schreder; Leonhard Dörner, all of Oberderdingen, Fed. Rep. of Germany

[73] Assignee: EGO Elektro Geräte Blanc u. Fischer, Fed. Rep. of Germany

[21] Appl. No.: 868,260

[22] Filed: May 28, 1986

[30] Foreign Application Priority Data

May 30, 1985 [DE] Fed. Rep. of Germany ..... 3519350

[51] Int. Cl.[4] ..... H05B 3/68; H05B 3/18

[52] U.S. Cl. ..... 219/464; 219/467; 219/544; 219/548; 219/536; 219/457

[58] Field of Search ..... 219/464, 467, 542, 544, 219/546, 547, 548, 536, 345, 457; 338/226, 275, 299

[56] References Cited

U.S. PATENT DOCUMENTS

| | | | |
|---|---|---|---|
| 3,904,539 | 9/1975 | Ruff | 252/62 X |
| 4,471,214 | 9/1984 | Gössler et al. | 219/464 |
| 4,590,360 | 5/1986 | Maintenaz | 219/407 X |

FOREIGN PATENT DOCUMENTS

| | | |
|---|---|---|
| 2551137 | 5/1977 | Fed. Rep. of Germany . |
| 2740163 | 9/1978 | Fed. Rep. of Germany . |
| 2729929 | 1/1979 | Fed. Rep. of Germany . |
| 2820114 | 11/1979 | Fed. Rep. of Germany . |
| 3102935 | 9/1982 | Fed. Rep. of Germany . |
| 3129239 | 2/1983 | Fed. Rep. of Germany . |
| 3144661 | 5/1983 | Fed. Rep. of Germany . |

OTHER PUBLICATIONS

DE-Buchi: H. Salmang: Springer Verlag: Die Physikalischen und Chemischen Grundlagen der Keramik 4.verbesserte Aufl. Kap.VIII, Berlin/Gottingen/-Heidelberg, 1958, S. 252-257.

German Search Report for German Appln. No. P 3519350.6.

*Primary Examiner*—M. H. Paschall
*Assistant Examiner*—H. L. Williams
*Attorney, Agent, or Firm*—Steele, Gould & Fried

[57] ABSTRACT

In a radiant heating unit, an insulating support for carrying a radiant heating resistor is molded or pressed using a granulation of expanded clay materials, particularly expanded mica or vermiculite. The granulation is compressed and bound in a blank by a mineral binder, particularly water glass, and the heating resistor is positively secured in the moulded granulation by embedding parts of the resistance wire forming the resistor, in such a way that the resistor is in part free of the insulating support on the front. The heating resistor can be embedded during production of the insulating support or can subsequently be pressed into the support. The insulating support of the heating unit is low in weight and easy to manufacture, has optimum electrical and thermal insulating properties and has very good strength, whereby the heating unit has a long service life.

24 Claims, 11 Drawing Figures

RADIANT HEATING UNIT

The present invention relates to a radiant heating unit, particularly for heating a plate, such as a glass ceramic hotplate, with an insulating support made from high temperature-resistant pressed material, to which is fixed at least one radiant heating resistor, being preferably partly exposed towards the front.

German Pat. No. 27 29 929 discloses a radiant heating unit of this type, in which the insulating support is pressed from an insulating material containing fibrous materials. This construction leads to advantageous results, particularly when using the heating unit on a glass ceramic plate. However, there is a need for more favourable solutions with regards to the simplicity of processing, the further improvement to the insulating properties and the increase in the efficiency of the heating unit.

The problem of the present invention is to provide a radiant heating unit of the aforementioned type which, although simple to manufacture, having good mechanical strength, low weight and long service life, ensures a high efficiency with respect to the irradiated heat.

According to the invention this problem is solved in the case of a radiant heating unit of the aforementioned type in that the insulating support essentially comprises a granulation of an expanded mica, such as vermiculite pressed or moulded with a binder. Such expanded micas are generally used in the building field and in technology for relatively large thermal insulations. It has surprisingly been found that this material can be used with particular advantage for manufacturing an insulating support of the type of the invention, even though the support is generally given relatively small dimension and a fine structure, and the heating resistors are usually heater coils made from thin wire and consequently problems can occur when fixing the heating resistor to the insulating support. As a result of the relatively bare, reflecting surface of the finished expanded mica, there is also an extremely good reflecting action with respect to thermal radiation from the heating resistor, and simultaneously the pressed expanded mica provides alternate reflecting and thermal insulating particles in the core of the insulating support. Therefore even in the case of a relatively thin-walled construction of the latter, an extremely good insulation in the manner of a superinsulation is obtained. Although it is possible to use other micas which have flaked off by exfoliation under heat action for the purpose of producing the insulating support, the silicates of the vermiculite series are particularly suitable for this and more especially trioctahedral vermiculite as the clay material.

Numerous different materials can be used as the binder, inter alia e.g. cement or silica sol. However, for the purpose of producing the insulating support a particularly suitable binder is a water glass solution, because on the one hand this binder ensures a high strength in the case of a relatively tightly closed surface and low degree of compression and on the other hand can have such a low weight proportion in the finished insulating support that the latter consists of almost 100% expanded mica and optionally other admixtures. In order to still obtain a good, rapid processing, when mixed with the expanded mica the binder in the unpressed state represents approximately 10 to 40% by weight and preferably approximately 30% by weight, so that it penetrates between the fine-scaled structure of the expanded mica and adjacent particles of the granulation are inserted in one another in tooth system-like manner during compression or moulding and can be bonded together in this tooth-engagement zone.

Tests have shown that the binder, particularly in the case of a density of approximately 37° to 40° Be' appropriately has a maximum two thirds proportion of water, the other portion preferably comprising approximately 8% sodium oxide and 27% silicon oxide, so that a sodium silicate solution is obtained with a weight ratio of the solids of approximately 1:3.35. This solution has a sufficiently low viscosity to ensure a good thorough mixing with the expanded mica in the case of a relatively low mixing energy. Very good strength and surface characteristics of the insulating support on the one hand and highly effective insulating characteristics on the other have been obtained if the expanded mica is pressed with the binder to approximately one fifth of its unpressed volume with respect to the insulating support, very good results having been obtained with a pressing degree of 5.3:1.

Particularly when using at least one heater coil as the heating resistor great importance is attached in the case of the radiant heating unit to the fact that the heating resistor is adequately securely held on the insulating support and is arranged in such a way that heat can be irradiated therefrom in a maximum unimpeded manner. It can be assumed that through the alternating loading due to glowing and cooling the heating resistor performs movements which can bring about a loosening. Although the heating resistor can be fixed to the insulating support by separate fixing means, e.g. clips or the like arranged in spaced succession and which engage in or penetrate the insulating support, a particularly advantageous construction for the operational reliability of the heating unit is obtained if the heating resistor is fixed to the insulating support by direct embedding in the compressed granulation. It has surprisingly been found that, compared with a fibrous pressed material, this granulation can very adequately secure the heating resistor. Thus, during the embedding of the heating resistor, which generally comprises wire with a circular cross-section, the individual, laminated particles of the expanded mica are displaced with increased pressure against the surface of the heating resistor and accompanied by shape adaptation to said surface, in such a way that they mesh in one another in this region in the described manner and even in the case of a limited embedding depth and relatively large embedding intervals ensure a reliable hold of the heating resistor without any additional fixing means. A part is played by the fact that the binder has a thin skin also joined to the heating resistor surface and particularly after hardening reinforces the expanded mica particles adjacent to this surface in the manner of interlocking members, which permanently and in a dimensionally stable manner at least partly embrace the heating resistor cross-section. Simultaneously the alkali metal silicate acts as a corrosion inhibitor, so that at least in the embedded region the heating resistor is protected. The adhesiveness of the binder is extremely good both with respect to the metal of the heating resistor and with respect to the inorganic silicon compound forming the granulation. It is conceivable to wet with the binder by a dipping process, spraying or the like the fixing means provided for engagement in the insulating support or portions of the heating resistor or the entire heating resistor prior to fitting to the insulating support and then immediately following this to carry out the embedding, thereby further improving the described effects.

In order to ensure an optimum reliable hold of the heating resistor and also that the surface provided for heat irradiation is as large as possible, it is advantageous if in the vicinity of adjacent longitudinal portions, the heating resistor is embedded to a varying depth and in particular alternately succeeding portions in each case have approximately the same depth. However and in particular in an alternating manner, longitudinal portions of the heating resistor can be provided which are completely free, i.e. are neither embedded, nor in direct contact with the insulating support nor positioned with an internal spacing with respect thereto. However, it has surprisingly been found that even if the heating resistor is relatively tightly filled with the granulation, e.g. when using a heater coil the coil interior is filled substantially over the entire length of the heating resistor, a particularly good glow pattern of the resistor can be obtained with excellent heat irradiation, particularly if the filling in the coil is not excessively compressed or is kept loose in an almost uncompressed form.

In order to further simplify the construction of the heating unit, in the vicinity of the particular longitudinal portion the heating resistor is embedded with at least one turn in the granulation, so that there is no need to give the heating resistor separate fixing members, which have to be constructed in one part therewith and project over the same in the direction of the insulating support core. Such fixing member could be individual turns drawn out of the otherwise aligned turn union, shaped out hairpin-like support or similar configurations producible from wire by bending.

With most cross-sections of the conventionally used heating resistors, the described embedding in the granulation ensures an adequately firm hold if at least one heating resistor turn is embedded in the granulation at th most up to its inner circumference, i.e. if the arc angle by which the turn is embedded is less than or max 90° and the inner circumference of the turn is substantially exposed. This can apply for all the turns of the heating resistor or for individual, e.g. zonally succeeding turns. Correspondingly at least one heating resistor turn can be surrounded by the compressed granulation over at least part of its inner circumference and this can once again apply to all the resistor turns or only to zonally succeeding turns, which in particular depends on the cross-sectional shape and size of the heating resistor.

Independently of the described manner of embedding or in addition thereto, it is advantageous if at least one turn of the heating resistor is embedded at the most up to its center in the in the compressed granulation, i.e. if it is filled with the granulation at the most up to its axial plane roughly parallel to the front of the insulating support. As a result at least one half of the turn or all such engaging turns are completely free, which gives a very advantageous glow pattern. Individual or all the turns can also engage in the granulation over and beyond said center or can be filled with the granulation, thereby forming particularly reliable fixing zones. The granulation of this filling also forms numerous small reflectors in the most varied directions as a result of the metallic bright surfaces thereof, so that there is a diffuse emission of the heat rays and a very uniform temperature pattern over the radiation surface.

Particularly if the heating resistor is uniform over its entire length, e.g. is not constructed with shaped out fixing members, in the case of a simple construction a very reliable fixing is obtained in that longitudinal portions of the heating resistor are embedded in protuberances of the insulating support, which preferably project over a support surface otherwise located in one plane. These protuberances are appropriately webs located at right angles to the longitudinal portions of the heating resistor or intersecting the same and which are preferably arranged radially about the central axis of the insulating support, as well as the configuration in which the heating resistor is placed. Thus, the heating resistor can be in a single plane and is zonally engaged by the protuberances in such a way that it is very deeply embedded therein and is consequently reliably held. The holding power exerted by the protuberances on the heating resistor is substantially not reduced if the protuberances undergo a width decrease in cross-section to the apex thereof, particularly if they are approximately semicircular, which leads to a high mechanical strength of the protuberances and ensures that a larger proportion of the heating resistor surface is exposed than would be the case with non-width-decreasing protuberances. Compared with an e.g. trapezoidally width-decreasing shape, the rounded decrease of said width is more suitable for the strength of the protuberances.

Despite very good insulating characteristics the insulating support can be given a relatively smooth and tightly closed construction on the surface if the granulation is more tightly compressed on the surface boundary layers than on the core in the areas adjacent to the heating resistor and this also keeps insulating support surface abrasion relatively low. Instead of this or in addition thereto, it can be advantageous to provide the outer faces of the insulating support with a varnish, which is preferably black for heat emission reasons, or some similar surface treatment. The mechanically more dense and optionally better heat conducting surface coating of the insulating support can also be produced without any subsequent treatment by a corresponding composition of the granulation. However, it is particularly advantageous that, after removing the blank from the mould, the surface is treated with a material which brings about the desired properties. It can e.g. be a silica sol or a silicon oxide in colloidal form which is uniformly sprayed. However, instead of this or in addition thereto, there can be a planned treatment in the vicinity of the embedded portions of the heating resistor, in that e.g. spray nozzles are arranged in the vicinity of the corresponding fixing points to the pressing tool or mould. It is also possible to achieve increased mechanical strength and better heat dissipation in the fixing regions between heating resistor and insulating support, with significantly otherwise influencing the insulating properties of said support. As the granulation act hydrophobically after moulding, e.g. due to heat treatment, such as annealing, it is possible to ensure a low depth penetration of a surface treatment or coating, so that the thermal insulation action is not decreased. The hydrophobic characteristics can also be improved by a silicone treatment.

To further increase the thermal insulating properties the granulation is compressed between the individual particles thereof, whilst leaving free air chambers, so that not only is air present between the lamellar or scale-like layers of the individual grain, but also between two adjacent grains, whose size is the roughly of the same order of magnitude as at least part of the granulation in the pressed state.

Thus, the granulation is appropriately passed just to that extent which appropriate for obtaining the desired strength characteristics.

The heating resistor can in simple manner be fixed with the pressing of the granulation on the insulating support in a single operation and in this case, with a corresponding construction of the mould receiving the heating resistor, the turns or coils of the heating resistor can be filled to a greater or lesser extent in the described manner. It has also been found that the insulating support can be pressed or moulded into shape in a preceding operation and then the heating resistor can be embedded by pressing it into the corresponding insulating support surface, particularly prior to the drying thereof at those points where it is to be embedded. In the vicinity of the heating resistor portions entering the insulating support, the granulation is compressed by the same, in part accompanied by the formation of an elastic tension, so that following adequate deep penetration of the associated heating resistor cross-section, the granulation springs back and at least partly closes again over the associated heating resistor portion and consequently positively engages round said resistor in said portion. The insulating support surface essentially remains in the shape which it had prior to compression, i.e. the particular heating resistor turn is only filled by the amount by which the heating resistor has been pressed into the surface of the insulating support.

It has proved advantageous if the granulation of the insulating support in the unpressed state has particles which are of the same order of magnitude as the internal coil spacings of the heating resistor, because as a result the penetration of the granulation into the interior of the resistor turns is significantly reduced or in the case of penetration the filling in the turns is relatively loose and is only weakly compressed. Instead of this or in addition thereto the granulation of the insulating support can comprise particles of different and preferably widely differing sizes. For example, a granulation between 1 and 2 mm has proved to be advantageous. The particles of different sizes can be mixed together and then compressed. However, it is also advantageously conceivable to build up the insulating support from layers of different granulations or to provide over the surface boundary layer carrying the heating resistor zones of different granulation in such a way that e.g. there is a different granulation in the embedding zones than between said bedding zones. According to a preferred embodiment in the vicinity of the surface boundary layer carrying the heating resistor the granulation is finer than in the adjacent layer or layers, so that the granulation becomes coarser from the front to the rear of the insulating support. Apart from the advantage that when fixing the heating resistor, it is reliably held by pressing in to an even relatively limited penetration depth, there is the further advantage that the insulating characteristics of the insulating support increase continuously or in stepped manner from its front to its back. Apart from a substantially flat, card-like shape, the insulating support can be in the form of a cup wheel and be provided on its circumference with a rim projecting over its front and/or back and is then appropriately less compressed and/or is formed from a coarser granulation than that of the base carrying the heating resistor.

In the vicinity of the heating resistor, the insulating support is appropriately made as thin as possible, so that it only projects at the back over the resistor to the extent necessary for a satisfactory electrical insulation. This can e.g. be achieved if the minimum spacing of the heating resistor from the back of the insulating support is at the most as large as its diameter and is in particular smaller. Thus, the electric lines used for connecting the heating resistor can also be passed through the insulating support over the shortest distance at the back thereof and from there can be lead into a zone in which they are accessible for the connection to the electrical connecting means.

In order to significantly increase the thermal insulation at the back of the insulating support, particularly in the case of a relatively thin construction of the support region carrying the heating resistor and secure the support against local mechanical overloads, the back of the insulating support is engaged with a soft and in particular elastically deformable insulating bed formed from at least one layer. If the heating unit is used for heating a plate, e.g. a glass ceramic hotplate, it is appropriately fixed by the insulating support rim against the underside of said plate and then the elastically deformable insulating bed on the insulating support side remote from said plate forms a large-area and uniformly engaging spring member, which presses the insulating support against the plate under pretension. The insulating bed appropriately comprises a pourable insulating material, which e.g. has as the base material pyrogenic silicic acid, such as that marketed under the trade name "Aerosil" by Degussa. Furthermore ceramic fibres, e.g. aluminium silicate fibers can be used for reinforcement purposes. If the insulating support is constructed in one piece with the insulating bed, then said components and optionally an opacifier can be directly admixed with the expanded mica granulation to be compressed or moulded.

A particularly easily handled, namely easily mounted, transported and fitted heating unit is obtained if the insulating support and optionally the insulating bed are arranged in a thin-walled support dish, particularly made from sheet metal and preferably prevented from rotating with respect said support dish by engagement in a connecting block for the heating resistor fixed thereto. On viewing the front, the heating unit is generally circular and provided with a single heating resistor. However, when viewing the front, the heating unit can also have any random other shape, e.g. a rectangular or square basic shape, s that it is particularly suitable for a cooking unit, which has several juxtaposed and/or successively arranged cooking points. It is also possible to provide two or more independently connectable heating resistors, preferably in interengaging spiral form, so that widely differing capacities can be provided with the heating unit. In all cases it is advantageous if the support dish is in one part and therefore has a very simple construction.

If, prior to the installation of the heating unit, axial securing of the insulating support with respect to the support dish is desired, there is no need for this to take place directly by engaging the dish in the support. Axial securing can instead be obtained by providing a temperature sensor, which passes through aligned openings in the support dish rim and in the insulating support. The openings in the insulating support can be produced in a simple manner by drilling after compressing the support, so that there is no need for a complicated mould and instead of the openings being in the form of grooves, there can be closed bores over the circumference.

Apart from the aforementioned steps, the invention also relates to a method for the manufacture of a radiant heating unit, in which an insulating support made from high temperature-resistant pressing material is produced and at least one radiant heating resistor is fixed thereto by partial embedding. According to the invention this method is characterized in that the pressing material is constituted by an expanded mica, such as vermiculite, which is mixed with a binder and then pressed or moulded into the form of the insulating support in a pourable granulation, after which parts of the circumference of the heating resistor are pressed into the associated compressed surface of the insulating support to embedding depth and then the insulating support with the pressed-in heating resistor is dried or alternatively or in addition thereto is further solidified by baking or annealing. Thus, on the surface of the insulating support forming its front and which serves to receive the heating resistor can initially be moulded in highly compacted form, so that the compacted granulation on penetration of the heating resistor does not tend to expand again and penetrate significantly beyond the pressing-in depth into the heating resistor. With its parts penetrating the granulation, the heating resistor forms a male mould, which partly elastically compresses the granulation in the vicinity of said parts again and into the deeper layers of the insulating support, so that said areas of the granulation passed by cross-sectional portions of the heating resistor during penetration and which then are located on the side of said cross-sectional portions facing the associated insulating support surface, spring back and consequently embrace said portions at least partly in positively tightly engaging manner with pretension. The further compaction of the granulation during the penetration of the heating resistor consequently not only takes place in the penetration direction, but also laterally parallel to the associated insulating support surface. In addition thereto or instead thereof, it is also conceivable to place the heating resistor in the associated mould prior to the compression of the insulating support and then during compression and accompanied by the penetration of parts of the heating resistor to embed same in the compressing granulation, so that in one operation the insulating support is pressed into shape and the heating resistor can be joined to a single assembly by partial embedding with the insulating support. In the last-mentioned procedure, the heating resistor can be embedded to a predetermined depth, which is less than its final embedding depth and then in the first-mentioned procedure following the compression of the insulating support can be pressed in a bit deeper to its final embedding depth, so that in the vicinity of the embedded parts of the heating resistor there is a particularly high compression of the granulation and consequently a relatively limited embedding depth is sufficient for the mounting support of the heating resistor. However, it is also possible in the case of arranging several heating resistors to embed one heating resistor with the compression of the insulating support and at least one further heating resistor is subsequently fitted by pressing in in the aforementioned manner. In all cases, it is possible to obtain a particularly reliable connection of the bare or uninsulated resistance wire heating resistor and the insulating support.

Particularly in the procedure, in which the heating resistor is embedded with the compression or moulding of the insulating support, a filling of the heating resistor turns with the granulation can be achieved, it being possible to proceed in such a way that said filling is not or not as strongly compressed as the insulating support zones adjacent to the heating resistor. If it is appropriate for obtaining a particular glow pattern to partly or completely remove said filling, this can take place after compression or moulding and particularly after drying in a simple manner, e.g. in that the granulation of said filling is made to drop out by vibrating or shaking movements of the insulating support or is removed by brushing out. Thus, in the vicinity of the heating resistor, there is a not tightly closed insulating support surface which is much rougher than the areas adjacent to the heating resistor and this can have an advantageous effect on the radiation behavior.

If also in the vicinity of the heating resistor a particularly tightly closed insulating support surface is appropriate, according to the invention it is possible to use an apparatus for producing a radiant heating unit with an at least two-part mould for the insulating support, whereof the front of the insulating support is associated with the male mould, which has moulding projections for the engagement between the turns of the heating resistor. The arrangement can be such that substantially between all the turns of the heating resistor or between all those turns which come to rest outside the protuberances of the insulating support engage pressing or moulding projections and longitudinal portions of the heating resistor can be provided between whose turns engage no such projections, whereas in adjacent longitudinal portions such projections engage, so that numerous different glow patterns and radiation effects can be obtained. The moulding projections have their moulding faces appropriately at least approximately in the plane of those moulding faces compressing the surface zones of the insulating support adjacent to the heating resistor. However, they can also stand back or project with respect thereto and in the first case there is an embedding of the heating resistor along a longitudinally projecting web on the associated insulating support surface and in the second case an embedding along a recessed groove or channel in the associated insulating support surface, so that different reflection angles for the radiation or emission is obtained.

BRIEF DESCRIPTION OF THE DRAWINGS

The foregoing features and further features of preferred further developments of the invention can be gathered from the description and drawings and the individual features can be realized alone or in the form of subcombinations in an embodiment of the invention and in other fields. Embodiments of the invention are described in greater detail hereinafter relative to the drawings, wherein.

DETAILED DESCRIPTION OF THE PREFERRED EMBODIMENT

Figure 1:
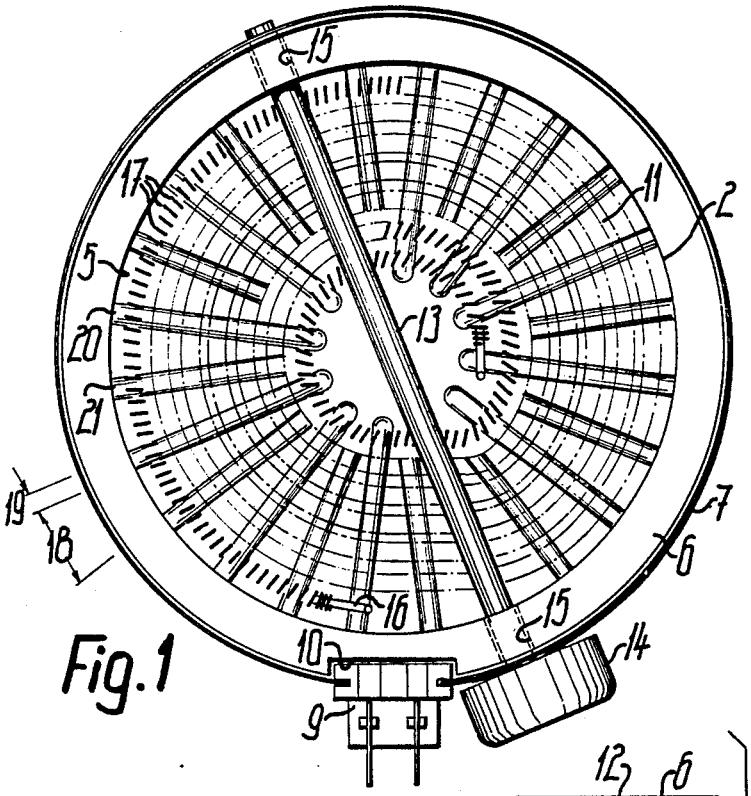
FIG. 1 is an inventive radiant heating unit as viewed from the front or top side.
Figure 2:
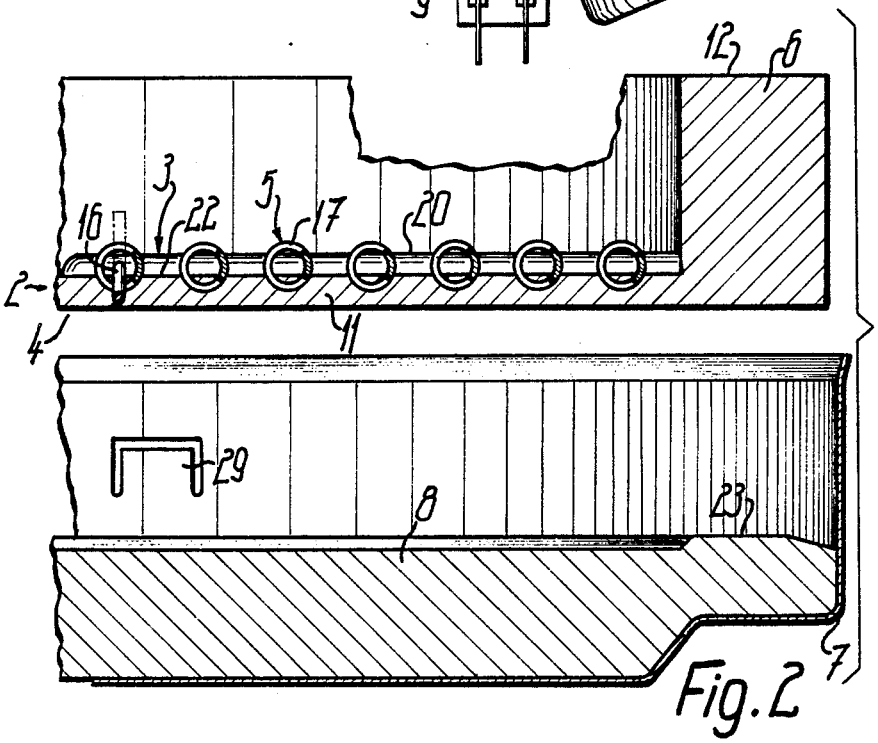
FIG. 2 is a detail of FIG. 1 in a larger scale axial section and with the insulating support raised from the support dish.

As shown in FIGS. 1 and 2, an inventive radiant heating unit 1 has a card-like, thin and substantially planar insulating support 2 with a heating resistor 5 affixed to the front side thereof and a rim 6 projecting on the outer circumference over said front side. The insulating support 2 is placed in a sheet metal support dish 7 provided over part of its height with an insulating bed 8. In a cutout on its circumferential wall, support dish 7 receives a connecting block 9 made from insulating material, e.g. a ceramic material, which projects both over the inner circumference and over the outer circumference of the circumferential wall and engages in a cutout 10 on the outer circumference of the insulating support 2 or rim 6, in such a way that the insulating support 2, relative to its central axis, can only assume a single position relative to support dish 7 or connecting block 9 and in this position is prevented from turning in the fitted state. The rim 6 of insulating support 2, which is provided on the inner and outer circumference with continuous, shoulder-free circumferential lines, projects over the open front of the support dish 7 at least approximately by the thickness of the thin base 11 receiving the heating resistor 5, so that the heating unit 1 can be fixed to the inside or underside of a plate, such as a glass ceramic hotplate with the annular, planar end face 12 of the rim 6 which projects over the entire thickness of the latter. Rim 6 constructed in one piece with the base 11 as a pressed or moulded body, is appropriately less strongly compressed or compacted than the base 11, so that in its pressing direction against the plate it has less elastic resiliency properties and therefore the pressing force acts substantially uniformly over the entire end face 12. The front 3 of base 11 of insulating support 2 is faced by the rod-like temperature sensor 13 of a thermal cutout 14, thermostat or the like, the temperature sensor 13 engaging in openings in rim 6 of insulating support 2, as well as in the circumferential wall of support dish 7, so that the insulating support 2 is secured in its axial position with respect to dish 7. The thermal cutout 14 or the like is immediately adjacent to the connecting block 9, which has outwardly directed plug tongues for electrical connection, so that the heating resistor 5 and thermal cutout 14 or the like can be connected in closely juxtaposed manner to electric lines.

Heating resistor 5 is formed by a wire coil having a continuous pitch and a constant diameter substantially over its entire length and whose turns are closely engaged at both ends for receiving wire-like connecting pins 16. The helical coil forming heating resistor 5 is laid in spirals, which are parallel to base 11 and substantially equidistantly follow the outer circumference of the heating field, i.e. the inner circumference of rim 6, whereby the height thereof corresponds to the external diameter of the coil turns 17 and embedded over part of said height in the front of insulating support base 11 in such a way that over a further part of the height thereof and at least on numerous longitudinal portions 18 of heating resistor 5 is exposed in mechanically bright manner on the front 3 of insulating support 2. Turns 17 can be circular or can have a diverging shape, e.g. oval.

On the front side 3, insulating support base 11 has a plurality of web-like protuberances 20, 21, which are arranged radially around the central axis of insulating support 2 and project over the otherwise planar associated surface 22 of base 11 by an amount which is roughly equal to the thickness of base 11 between protuberances 20, 21. The protuberances 20, 21 emanating from rim 6 or the outer circumference of base 11 extend alternately inwards to a differing radial extent, so that they are spaced from one another in the vicinity of their radialy inner ends. On the portions 19 at which the heating resistor 5 passes through said protuberances 20, 21 substantially at right angles, resistor 5 is more deeply embedded corresponding to the height of the protuberances than in the area of the portions 18 located between them, where resistor 5 is completely free without embedding and can e.g. have an internal spacing from surface 22. The electric lines (not shown) to be connected to the pins 16 or the like of heating resistor 5 are appropriately lead directly adjacent to the particular associated pin 16 through the base 11 on the back surface 4 thereof and between the latter and the insulating bed 8 engaged thereon to connecting block 9 or the thermal cutout 14 or the like, for which purpose insulating bed 8 has a corresponding depression on the side facing insulating support 2.

Insulating bed 8, which is appropriately formed by a charge moulded in the support shell 2 and is softer, i.e. particularly more easily elastically deformable than insulating support 2 or its rim 6 is supported on the bottom of support dish 7 and forms with a limited ring spacing adjacent to the circumferential wall thereof, a narrow annular engagement surface 23 for the back 4 of insulating support 2. On the outer circumference, said surface 23 is bounded by a set back ring surface, so that there is a precisely defined engagement of the insulating support 2 on insulating bed 8. Engagement surface 23 is also bounded by a set back depression in insulating bed 8 on the inner circumference.

Insulating support 2 is produced in a two-part mould (not shown), whose two parts, namely the female part and the male part in the closed state form a shape corresponding to that of the finished insulating support. When the mould is open, a previously weighed quantity of an expanded mica mixed with binder is poured into one mould part, particularly that part forming the front 3 of the insulating support 2 and by closing the mould it is moulded to insulating support 2 in a waste-free manner and without any reworking being necessary. The heating resistor 5 can be previously placed in the mould part forming the front of the insulating support 2, e.g. in a corresponding spiral groove or in mould projections arranged on a spiral ring, followed by pouring onto the heating resistor. Furthermore pouring can take place successively in different granulations, e.g. in such a way that initially finer granulation is poured into a roughly uniform thick layer, followed by coarser granulation. During moulding or compression, the insulating body is substantially compressed into its final shape and the heating resistor portions projecting over the associated pressing face of the mould part receiving the heating resistor are embedded within the compacting granulation are or are so pressed round by the latter that they are at least partly surrounded giving a firm hold. In the case of a multilayer construction obtained by two or more layers of different granulations, the insulating support 2 can be completely moulded in a single operation. However, it is also possible to bring about a layer-wise moulding or compression, e.g. if different layers are to be compressed to a varying extent, the layers located within the finished insulating support being roughened for better connection to the layers to be built up thereon by corresponding shaping of the pressing or moulding face of the mould part or by mechanical working after intermediate pressing. The inventive construction permits the use of completely fibre-free materials for the production of the insulating body, although it would be conceivable to admix fibrous, e.g. mineral components. There is essentially no material loss in producing insulating support 2 and after a possible annealing treatment the insulating support is hydrophobic. The binder can in particular be constituted by a mineral glue and water glass has proved to be particularly advantageous.

Of the numerous further possibilities, FIGS. 3 to 8 three examples of the anchoring of the heating resistor in the insulating support, each of the examples applying to the overall anchoring of the resistor to a support, or being combinable with one or more of the other examples particularly in such a way that differing anchoring systems are alternately provided on different longitudinal portions of the heating resistor. The same reference numerals as in the preceding drawings are used for corresponding parts in FIGS. 3 to 8, but in FIGS. 3 and 4 a is added, in FIGS. 5 and 6 b, in FIGS. 7 and 8 c, in FIG. 9 d, in FIG. 10 e and in FIG. 11 f are added.

Figure 4:
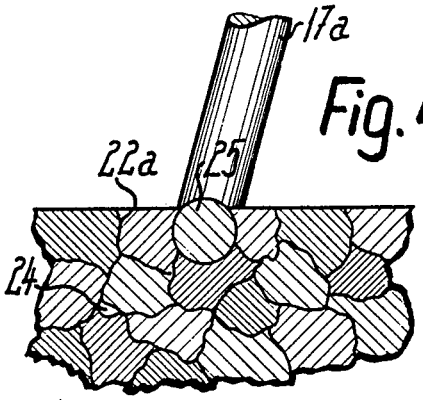
FIG. 4 is a simplified section along line IV—IV in FIG. 3 in a further larger scale representation.
Figure 3:
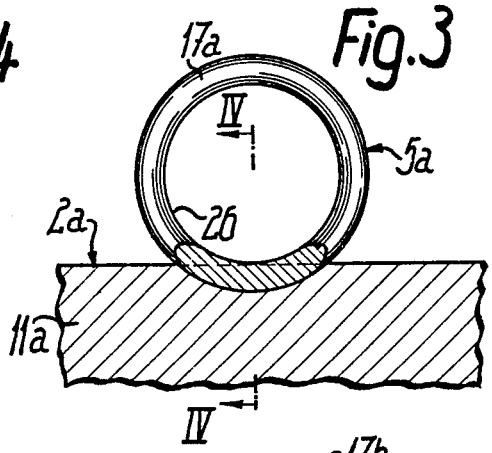
FIG. 3 is a detail of the insulating support in a simplified cross-section through the heating resistor.

In the embodiment according to FIGS. 3 and 4, the turns 17*a* of heating resistor 5*a*, particularly those located in the vicinity of the portions 18 according to FIG. 1 are embedded to a depth in the base 11*a* of insulating support 2*a* which is at the most as large or, in the represented embodiment, even slightly smaller than the associated cross-sectional size of the resistance wire forming heating resistor 5*a*, i.e. when using a round wire the wire diameter thereof. In FIG. 4 the individual particles of the compressed granulation from which the insulating support 2*a* is made are shown. The individual particles are flake-like, laminated particles and in a not shown manner can consequently slightly penetrate one another in their adjacent regions, whilst undergoing a reciprocal meshing effect. Simultaneously the granulation is only compressed to the extent that between the individual particles cavities in the form of air chambers 24 are formed, whereof one is shown in FIG. 4 and can be smaller or roughly the same size as the particles of the granulation. In the vicinity of the part 25 of the particular turn 17*a* engaging in the insulating support in the manner of a ring segment, the individual particles of the granulation cling together with a particularly high compression and surface-closed deformation on the surface of said part 25, to which they are adhesively and positively connected in that they receive said part 25 in a substantially undercut opening and consequently engage round the same in claw-like manner. In the case of the embodiment according to FIGS. 3 and 4, the inner circumference 26 of turns 17*a* remains completely free. However, it is also conceivable to fill the inner space of heating resistor 5*a* defined by said inner circumference 26 and located outside the compressed surface 22*a* more or less high and/or densely with particles of the granulation during the production of insulating support 2*a*. These particles are then appropriately less densely compressed than the remaining areas of the insulating support or are just compressed strongly enough that they do not automatically fall out.

Figure 6:
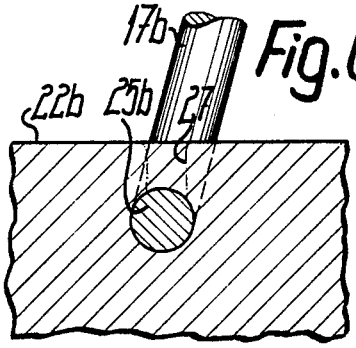
FIGS. 5 to 8 are two further embodiments in representations corresponding to FIGS. 3 and 4.
Figure 5:
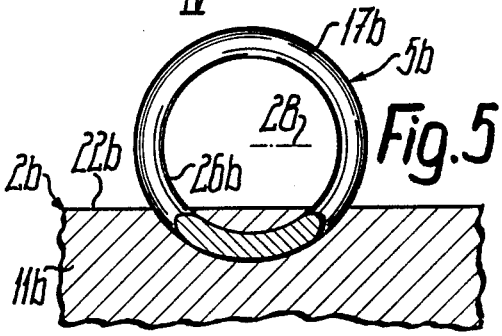

In the embodiment according to FIGS. 5 and 6, the engaging part 25*b* of turn 17*b* is surrounded by the material of insulating support 2*b* over the entire cross-section of the resistance wire, so that part of the inner circumference 26*b* is covered. However, in the vicinity of turn 17*b*, surface 22*b* does not extend up to the center of the height thereof, i.e. not up to that axial plane 28 of turn 17*b*, which is parallel to the surface 22*b* or the insulating support base 11*b*. This arrangement can be produced in a particularly simple manner if the heating resistor 5*b* is produced simultaneously with the moulding of insulating support 2*b*. During the subsequent embedding by pressing the heating resistor 5*b* into the insulating support 2*b*, in the vicinity of the embedded part 25*b* it is possible to form a slot-like groove 27 in the insulating support which passes through surface 22*b* and is indicated by dot-dash lines in FIG. 6, its width being smaller than the wire diameter of heating resistor 5*b*, but leaves free towards the front of the insulating support a portion of the circumferential surface of the embedded part 25*b*.

Figure 8:
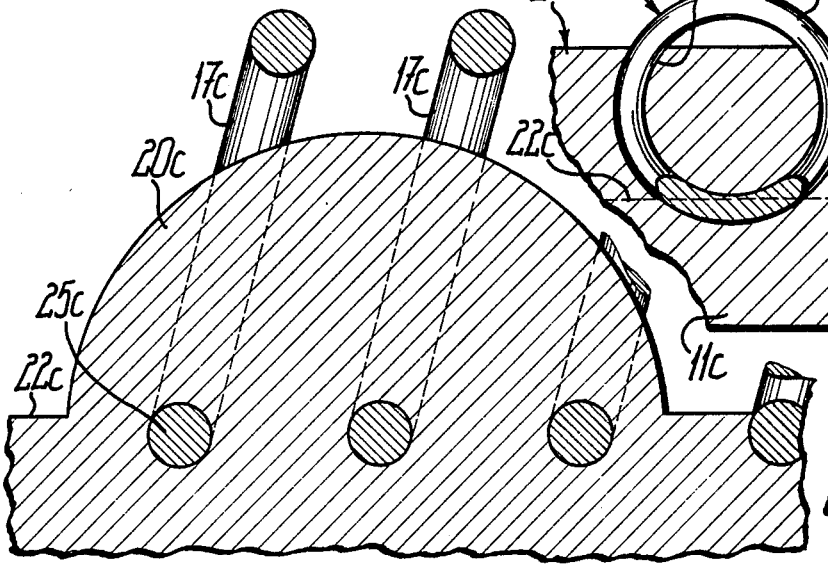
Figure 7:
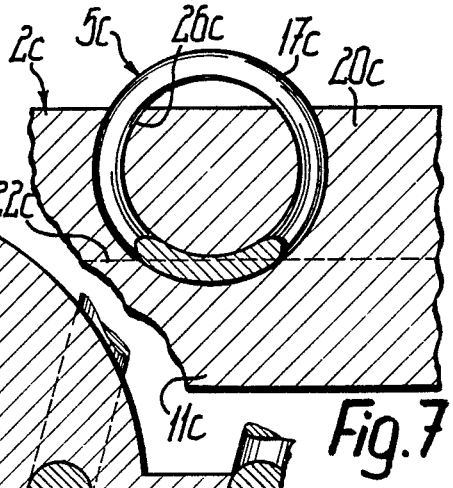

FIGS. 7 and 8 show an embedding of the turn 17*c*, as is particularly appropriate in the vicinity of protuberances 20*c*. Protuberance 20*c* is in cross-section defined in an approximately semicircular manner and has a width such that it can receive in embedding manner at least two successive turns 17*c* or their associated parts 25*c*. Protuberance 20*c* extends beyond the center of the height of the particular turn 17*c*, so that it surrounds same over most of its inner circumference 26*c*. According to FIGS. 7 and 8, in the vicinity of protuberances 20*c*, part of the circumference of the particular turns 17*c* projects freely to the front of the insulating support, although the turns 17*c* can also be surrounded almost over the entire outer circumference in the vicinity of protuberances 20*c*, i.e. are embedded over their entire height or entire outside diameter. According to FIG. 2, pins 16 are appropriately also embedded in insulating support 2 and consequently anchored in position and like the remainder of the heating resistor can be anchored either at the time of moulding the insulating support, or by subsequent pressing in.

For securing the insulating support 2 with respect to the support dish 7 axially and/or in the rotation direction, fixing members in the form of e.g. bending members 29 can be provided in the circumferential wall of dish 7 and these engage in rim 6 of support 2. In the represented embodiment, the bending members 29 are formed U-shaped slot stampings, in such a way that upwardly directed bending tongues are formed which, according to FIG. 9, after inserting the insulating support 2*d* are pressed between the end faces thereof into its outer circumference. The bending tongues 29*d* according to FIG. 9 automatically produce there reception depressions in insulating support 2*d* by displacing the compressed moulding material, so that there is no need to shape said recesses before hand into support 2*d*. Appropriately there are at least two and in particular three bending tongues 29*d* uniformly distributed over the circumference.

Figure 9:
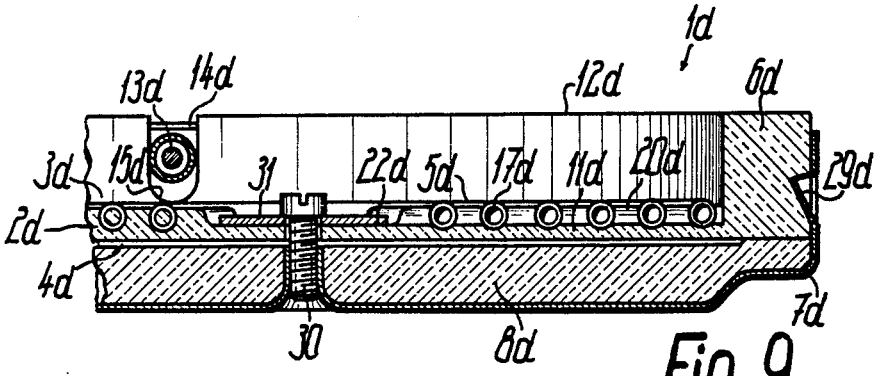
FIGS. 9 to 11 are three further embodiments of heating units in axial section.

In the case of the embodiment according to FIG. 9, the center of the base 11*d* of insulating support 2*d* is positively secured by a fixing member 30 with respect to the support dish 7*d* or insulating bed 8*d*, so that even in the case of an extreme thin construction of base 11*d* there is no danger that this will curve upwards with corresponding powerful heating. In the represented embodiment the fixing member 30 is formed by a screw thread located in the central axis of the heating unit and which engages in the internal thread of a sleeve shaped upwards from the base of dish 7*d* and whose head is supported on the surface 22*d* of insulating support 2*d* accompanied by the interposing of a shim 31. It is also conceivable to obviate the use of a screw and to e.g.

construct the fixing member in one part with the support dish 7d in such a way that the sleeve shaped upwards from the base of support dish 7d passes through the base 11d of insulating support 2d and is supported on the surface 22d thereof with a shaped tubular rivet head or radially outwardly bent retaining plates, which can be constructed in such a way that they can be bent for the non-destructive detachment of the insulating support 2d in its upright position. In order to prevent a bulging of the base 11d of insulating support 2d under thermal stresses, it is also possible to provide the central region of base 11d with expansion slots e.g. continuing over its thickness, so that thermal stresses are compensated. These slots can be positioned radially, arcuately about the central axis of insulating support 2 and/or tangentially to an imaginary circle about said central axis.

Figure 10:
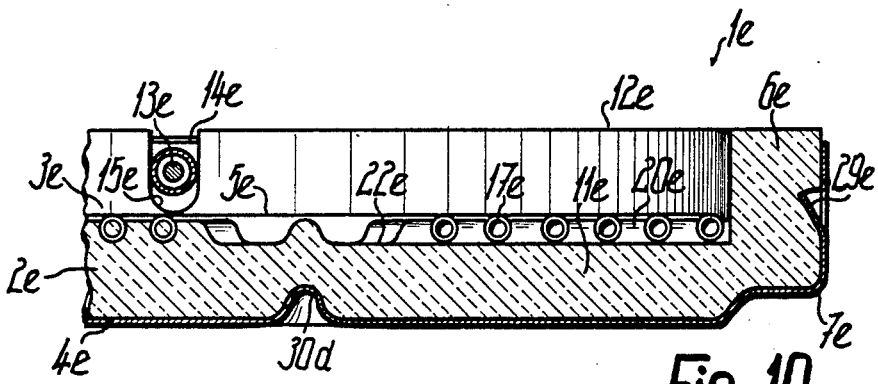

According to FIG. 10 base 11e of insulating support 2e can be replaced by a correspondingly thicker construction, as can the insulating bed, it being conceivable for base 11e to be more strongly compressed in the boundary layer adjacent to surface 22 than in the underlying area replacing the insulating bed. Base 11e of insulating support 2e consequently extends up to the inside of the base of support dish 7e. The base of support dish 7e is centrally provided with a stud-like, upwardly projecting protuberance 30e in its central axis, which engages into a corresponding depression on the bottom of base 11e of insulating support 2e and corresponds to a corresponding projecting stud-like protuberance on surface 22e. This increases an optionally adhesive connection between insulating support 2e and support dish 7e and it is also conceivable to absorb thermal stresses by this or a similar member 30e.

Figure 11:
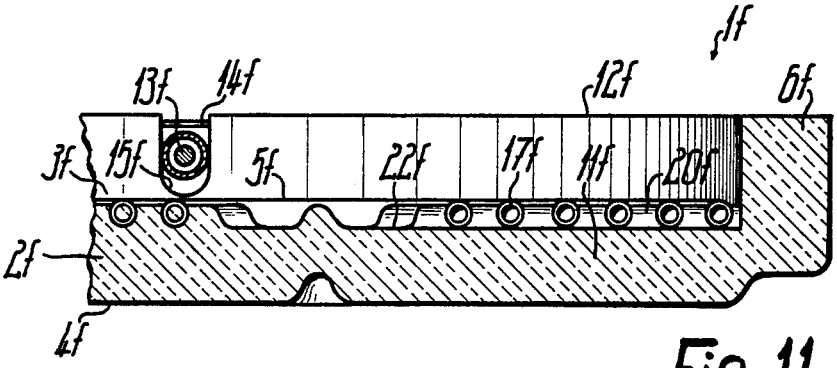

As shown in FIG. 11, heating unit 1f not only needs no seperate insulating bed, but also requires no support dish or base plate, if through a suitable mixing of the moulding material and a corresponding choice of the cross-sections and the compression, a correspondingly high strength of insulating support 2f is obtained. Such a support dish-free heating unit 1f is particularly suitable for heating large area baking ovens, such as are e.g. used in commercial kitchens. In this case, with a central axis differing from the vertical position, the heating unit can e.g. be arranged with a horizontal central axis on a side wall of the baking oven muffle. In each of the above embodiments, with a weight proportion of approximately 40% expanded mica and approximately 30% water glass, prior to moulding it is possible to add a mixture of pyrogenic silicic acid, opacifier and fibrous material with a weight proportion of approximately 15%, which can favourably influence the thermal insulation.

We claim:

1. A radiant heating unit, comprising:

an insulating support made from high temperature-resistant formed insulating material, at least one radiant heating resistor held in said insulating support, wherein the insulating support substantially comprises a granulation of an expanded mica, compressed with a binder.

2. A heating unit according to claim 1, wherein the mica is vermiculite.

3. A heating unit according to claim 1, wherein the expanded mica granulation is bonded with a water glass solution.

4. A heating unit according to claim 1, wherein when mixed with the expanded mica, the binder in an unpressed state represents between 10 and 40% by weight of the support and wherein the binder in the compressed insulating support represents at most a few percent by weight, the expanded mica being pressed to the insulating support with the binder to approximately one fifth of its unpressed volume.

5. A heating unit according to claim 1, wherein in an unmixed state the binder contents have a maximum approximately two thirds in weight of water, another approximately one third of the binder comprising 8% sodium oxide and 27% silicon oxide, the binder having a density of approximately 37° to 40° Baumé.

6. A heating unit according to claim 1, wherein the heating resistor has longitudinal portions and is fixed to the insulating support by direct embedding of longitudinal portions in the pressed granulation, the heating resistor being a heater coil having coil turns forming an inner circumference and a center therein, the coil turns being spaced apart by inner coil spacings, the heating resistor being embedded to varying depths in the vicinity of adjacent longitudinal portions, alternate succeeding longitudinal portions of the heating resistor being embedded to approximately the same depth respectively, the heating resistor being embedded in the granulation with at least one coil turn in the vicinity of the respective longitudinal portion, and wherein at least one coil turn of the heating resistor is embedded in the granulation at most up to its inner circumference.

7. A heating unit according to claim 6, wherein at least one turn of the heating resistor is surrounded by the compressed granulation, at least on part of its inner circumference, at least one turn of the heating resistor engaging at the most up to its center in the compressed granulation of the insulating support and at least one turn of the heating resistor being embedded in the granulation of the insulating support over and beyond its center.

8. A heating unit according to claim 6, wherein longitudinal portions of the heating resistor are embedded in protuberances of the insulating support, the protuberances projecting over a surface of the insulating support which is otherwise in one plane, the protuberances being webs lying at right angles to the longitudinal portions of the heating resistor, the protuberances being substantially radially arranged about a central axis of the insulating support and having a cross-section with an apex, the cross-sectional width deceasing towards the apex by a semicircular cross-section.

9. A heating unit according to claim 6, wherein at least one coil turn of the heating resistor is at least partly filled with a granulation accumulation which is less pressed than areas outside the heating resistor.

10. A heating unit according to claim 1, wherein the insulating support has surface boundary layer zones and a core, the granulation being more densely pressed at least in the surface boundary layer zones adjacent to the heating resistor than in the core, the granulation being pressed by leaving free air chambers in the insulating support, the air chambers having a size of approximately the same order of magnitude as at least part of the granulation.

11. A heating unit according to claim 1, wherein the heating resistor is fixed to the insulating support by the pressing of the granulation, the granulation of the insulating support comprising particles of the same order of magnitude as the inner coil spacings of the heating resistor and comprising particles smaller than the inner coil spacings of the heating resistor.

12. A heating unit according to claim 1, wherein the particles are mixed in different sizes of a plurality of different particle sizes.

13. A heating unit according to claim 1, wherein the granulation of the insulating support is thoroughly mixed with components of admixing materials, one component being a pyrogenic silicic acid, one component being an opacifier and one component being a fibre reinforcement, the admixing components representing less than one third of the granulation.

14. A heating unit according to claim 1, wherein the insulating support has a rear surface and a spacing of the heating resistor therefrom, the spacing of the heating resistor from the rear surface being at the most as large as an outer diameter of the heating resistor.

15. A heating unit according to claim 1, wherein the insulating support is cup-shaped and has a rim constructed in one piece with the support.

16. A heating unit according to claim 1, wherein a rear surface of the insulating support is engaged on a soft insulating bed of at least one layer, the insulating bed being constructed in one piece with the insulating support.

17. A heating unit according to claim 1, wherein the insulating support is arranged in a thin-walled support dish having a front, the insulating support being prevented from turning with respect to the dish by engaging in a connecting block for electrically connecting the heating resistor, said connecting block being fixed to the dish, the rim of the insulating support extending over a thickness and projecting over the front of the support dish by the entire thickness of the rim, the insulating support being axially secured with respect to the dish by a temperature sensor passing through aligned openings in the rim of the dish and in the insulating support.

18. A heating unit according to claim 1, wherein the heating unit is provided for heating in the vicinity of a glass ceramic hotplate.

19. A heating unit according to claim 1, the at least one radiant heating resistor has a circumference, parts of said circumference being pressed into an associated prepressed surface of the insulating support to an embedding depth, said insulating support being dried commonly with the pressed in heating resistor.

20. A heating unit according to claim 1, wherein the insulating support is pressed of a pourable granulation of insulating material, the insulating support having embedded parts of the heating resistor in the compressed granulation, the insulating support being dried commonly with the embedded heating resistor.

21. A heating unit according to claims 19 or 20, wherein the dried insulating support is baked and anealed.

22. A heating unit according to claims 19 or 20, wherein the coil turns of the heating resistor are free of the granulation above the support.

23. A heating unit according to claim 1, wherein turns of said heating resistor define gaps for receiving moulding projections of a male mould associated with a front of the insulating support.

24. A heating unit according to claim 4, wherein when mixed with the expanded mica the binder in an unpressed state represents approximately 30% by weight.

* * * * *